US007182171B2

(12) United States Patent
Weinert et al.

(10) Patent No.: US 7,182,171 B2
(45) Date of Patent: Feb. 27, 2007

(54) MUFFLER WITH VARIABLE ACOUSTIC PROPERTIES

(75) Inventors: Rico Weinert, Gommersheim (DE); Alexander Schinko, Mannheim (DE); Bernd Fuhrmann, Dudenhofen (DE); Katja Hirschberger, Mutterstadt (DE); Michael Burkart, Siebeldingen (DE)

(73) Assignee: Heinrich Gillet GmbH, Edenkoben (DE)

( * ) Notice: Subject to any disclaimer, the term of this patent is extended or adjusted under 35 U.S.C. 154(b) by 391 days.

(21) Appl. No.: 10/833,648

(22) Filed: Apr. 27, 2004

(65) Prior Publication Data

US 2004/0216950 A1 Nov. 4, 2004

(30) Foreign Application Priority Data

Apr. 29, 2003 (DE) ..... 103 19 212

(51) Int. Cl.

| | |
|---|---|
| ***F01N 7/14*** | (2006.01) |
| ***F16K 17/04*** | (2006.01) |
| ***F16K 17/30*** | (2006.01) |
| *F01N 1/16* | (2006.01) |

(52) U.S. Cl. ..... 181/237; 181/254; 60/324; 137/538; 137/540; 137/543.15

(58) Field of Classification Search ..... 181/237, 181/236, 241, 254, 271; 60/324, 322, 312
See application file for complete search history.

(56) References Cited

U.S. PATENT DOCUMENTS

| | | | | |
|---|---|---|---|---|
| 3,410,486 | A * | 11/1968 | Rodgers | 236/68 R |
| 3,455,316 | A * | 7/1969 | Rogers | 137/73 |
| 3,499,269 | A * | 3/1970 | Bois | 60/297 |
| 3,620,330 | A * | 11/1971 | Hall | 181/266 |
| 3,746,098 | A * | 7/1973 | Grenier | 169/37 |
| 3,894,713 | A * | 7/1975 | Ito et al. | 251/61.5 |
| 3,982,558 | A * | 9/1976 | Ochs | 137/455 |
| 4,052,969 | A * | 10/1977 | Ando et al. | 137/907 |
| 4,093,046 | A * | 6/1978 | Perr | 188/273 |
| 4,291,717 | A * | 9/1981 | Orcutt | 137/86 |
| 5,246,205 | A * | 9/1993 | Gillingham et al. | 251/334 |
| 5,365,963 | A * | 11/1994 | Hoffmann | 137/67 |
| 5,435,347 | A * | 7/1995 | Gillingham | 137/599.09 |
| 5,821,474 | A * | 10/1998 | Olszok et al. | 181/254 |
| 5,917,161 | A * | 6/1999 | Fuhrmann | 181/237 |
| 2002/0175022 | A1* | 11/2002 | Schumacher et al. | 181/254 |
| 2004/0178015 | A1* | 9/2004 | Wiemeler et al. | 181/237 |
| 2005/0155816 | A1* | 7/2005 | Alcini et al. | 181/237 |

FOREIGN PATENT DOCUMENTS

| | | | |
|---|---|---|---|
| DE | 19503322 | A1 * | 8/1996 |
| DE | 10106589 | C1 * | 8/2002 |
| DE | 10331479 | A1 * | 2/2005 |

* cited by examiner

*Primary Examiner*—Edgardo San Martin
(74) *Attorney, Agent, or Firm*—Klaus P. Stoffel; Wolff & Samson PC

(57) ABSTRACT

A muffler with variable acoustic properties. A pressure cell with a diaphragm, a spring, a piston, a piston rod, a closing element on the piston rod, and a pressure connection line are integrated into a housing. The diaphragm is thermally insulated against the piston rod. Another layer of thermal insulation is provided between the closing element and the pressure cell.

3 Claims, 1 Drawing Sheet

MUFFLER WITH VARIABLE ACOUSTIC PROPERTIES

BACKGROUND OF THE INVENTION

The invention pertains to mufflers with variable acoustic properties for pulsating gases.

A muffler with variable damping characteristics for pulsating gases is known from DE 195 03 322 C. This muffler comprises a housing; a gas feed pipe leading to the housing; pipes integrated into the housing; a pressure cell with a diaphragm, a spring, a piston rod, and a pressure connection, where the ambient pressure and the spring act on the low-pressure side of the diaphragm; a pressure line, which transmits the gas pressure to the high-pressure side of the diaphragm; and a closing element for opening and closing one of the pipes. The closing element is a valve disk, which is attached to the piston rod and which, when in the resting state, closes off the end of the gas feed pipe. A special feature of the known muffler is that the pressure line is integrated into the piston rod. This rod thus has an extension, which projects into the pipe which can be closed by the valve disk. Thanks to the pressure cell with its diaphragm, even the smallest pressure differences can be used to generate whatever forces are necessary to move the closing element. The design has only a few moving parts; it is simple, reliable, and inexpensive.

It is obvious that the hot, pulsating exhaust gases heat up the closing element, the piston rod, its guide bushing, and the pressure cell. Because the pressure cell is mounted outside the housing of the muffler, it will normally be cooled by the wind. In exhaust gas systems under high thermal loads, however, this natural cooling is not always sufficient. As a result, the temperature-sensitive components, especially the piston rod, the guide bushing, and the diaphragm, can age and corrode prematurely. This is unsatisfactory.

SUMMARY OF THE INVENTION

Accordingly, it is an object of the present invention to provide a muffler of the type indicated above which is also suitable for exhaust gas systems which operate under high thermal loads.

This task is accomplished by a muffler with the following features:

a housing, in which are integrated:

pipes;

an exhaust gas valve with a pressure cell containing a diaphragm, a spring, a piston, a piston rod, a closing element on the piston rod, and a pressure connection line; and a guide bushing for the piston rod;

the closing element closes off one of the pipes to a greater or lesser extent;

the diaphragm is thermally insulated against the piston rod; and a layer of thermal insulation is located between the closing element and the pressure cell.

Thanks to the effective insulation measures, the temperature-sensitive components of the exhaust gas valve are effectively insulated thermally. The insulation provides protection against both thermal conduction and thermal radiation.

The thermal insulation measures also relieve the piston rod and its guide bushing of thermal load. The transfer of heat to the highly stressed guide system is significantly reduced, reducing corrosion and wear.

Overall, by means of relatively few additional measures, a significant increase in service life is achieved. The muffler according to the invention can be used in exhaust gas systems which operate at very high temperatures.

The individual insulating measures can be used individually or in combination, depending on the thermal requirements.

The diaphragm is preferably insulated against the piston and the piston rod by means of two insulating disks. This simple design easily fulfills its purpose.

The insulating layer provides most of the insulating effect. This layer is located advantageously in a protective housing. This protects the insulation against the destructive effects of the pulsating gases.

It is advantageous to integrate the pressure connection line into the piston rod.

If the low-pressure side of the piston is connected to the outside atmosphere, the maximum possible pressure differential is available for the movement of the piston.

According to another embodiment of the invention, the package consisting of the piston rod, the piston, the spring, and the diaphragm is supported movably on a wire cushion. This provides a vibration-damping support, so that the vibrations induced by the pulsating gases or the vibrations of the moving vehicle can be elastically absorbed.

Other features and advantages of the present invention will become apparent from the following description of the invention which refers to the accompanying drawings.

BRIEF DESCRIPTION OF THE DRAWING

The FIGURE is a cross-section through a muffler pursuant to the present invention.

DETAILED DESCRIPTION OF THE INVENTION

Figure 1:
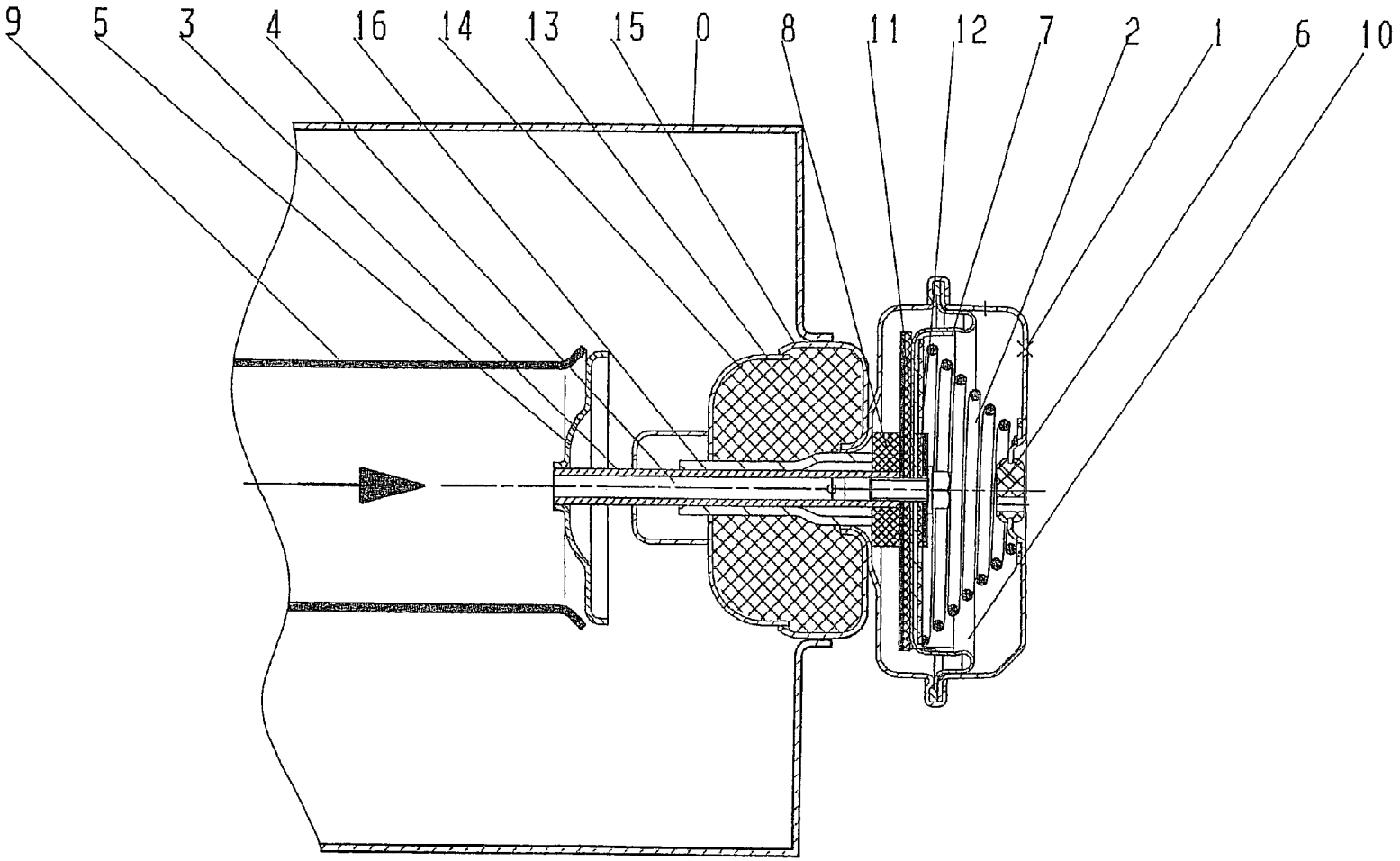

The FIGURE shows a cross section through part of a muffler for hot, pulsating gases; only one piece of the housing wall 0 is shown. With the help of a mounting bushing 15, an exhaust gas valve is mounted in an opening in the housing wall 0. This valve has a pressure cell 1 with a diaphragm 10, a spring 2, a piston 7, and a piston rod 3, in which a pressure connection line 4 is integrated. At the free end of the piston rod 3, a closing element 5 in the form of a valve disk is mounted. The closing element 5 opens and closes the cross section of a gas-carrying pipe 9, which is integrated into the muffler.

As soon as exhaust gases flow into the pipe 9, the positive pressure thus building up in it is transmitted through the pressure line 4 integrated into the piston rod 3 to the high-pressure side of the diaphragm, i.e., of the piston 7. The diaphragm opens against the force of the spring 2 and the pressure of the outside atmosphere, which acts through an opening 6 in the pressure cell 1 on the low-pressure side of the piston 7. As soon as the pressure difference is great enough, the piston 7, the piston rod 3, and the closing element 5 move toward the right, as a result of which the pipe 9 is opened and the exhaust gases can escape.

To reduce the thermal conduction from the closing element 5 via the piston rod 4 to the piston 7 and the diaphragm 10, the diaphragm 10 is covered on the front and rear surfaces by insulating disks 11, 12.

In addition, an insulating layer 14, surrounded by a protective housing 13, is provided in the mounting bushing 15. This insulating layer 14 prevents heat from being transmitted to the pressure cell 1. At the same time, it also protects the piston rod 3 and its guide bushing 16. The protective housing 13 prevents the pulsating gases from destroying the insulating layer 14.

The package consisting of the spring 2, the diaphragm 10, the insulating disks 11, 12, the piston 7, and the piston rod 3 is supported on a wire cushion 8. Vibrations are therefore elastically absorbed.

Although the present invention has been described in relation to particular embodiments thereof, many other variations and modifications and other uses will become apparent to those skilled in the art. It is preferred, therefore, that the present invention be limited not by the specific disclosure herein, but only by the appended claims.

What is claimed is:

1. A muffler with variable acoustic properties for pulsating gases, comprising:

a housing;

pipes integrated in the housing;

an exhaust gas valve integrated in the housing, the exhaust gas valve having a pressure cell containing a diaphragm, a spring, a piston, a piston rod, a closing element on the piston rod, and a pressure connection line;

a guide bushing arranged in the housing for the piston rod, the closing element being moveably arranged so as to close off one of the pipes to a greater or lesser extent;

the diaphragm being thermally insulated against the piston rod by two insulating disks arranged so as to thermally insulate the diaphragm against the piston and the piston rod, and a layer of thermal insulation located between the closing element and the pressure cell;

wherein the layer of thermal insulation is enclosed by a protective housing; and wherein the pressure connection line is integrated into the piston rod.

2. The muffler according to claim 1, wherein the piston has a low-pressure side connected to outside atmosphere.

3. The muffler according to claim 1, wherein the piston rod, the diaphragm, the piston, the insulating disks, and the spring form a package that is supported on a wire with freedom of axial movement.

* * * * *